US009852831B2

(12) United States Patent
Miyazoe et al.

(10) Patent No.: US 9,852,831 B2
(45) Date of Patent: Dec. 26, 2017

(54) SUPERCONDUCTING MAGNET

(71) Applicant: Hitachi, Ltd., Tokyo (JP)

(72) Inventors: Akihisa Miyazoe, Tokyo (JP); Takeshi Nakayama, Tokyo (JP); Ryuya Ando, Tokyo (JP); Manabu Aoki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/032,766

(22) PCT Filed: Nov. 15, 2013

(86) PCT No.: PCT/JP2013/080847
§ 371 (c)(1),
(2) Date: Apr. 28, 2016

(87) PCT Pub. No.: WO2015/072001
PCT Pub. Date: May 21, 2015

(65) Prior Publication Data

US 2016/0268028 A1 Sep. 15, 2016

(51) Int. Cl.
*H01F 6/00* (2006.01)
*H01F 6/02* (2006.01)
*H01F 6/06* (2006.01)

(52) U.S. Cl.
CPC ..... *H01F 6/008* (2013.01); *H01F 6/02* (2013.01); *H01F 6/06* (2013.01); *H01F 6/065* (2013.01)

(58) Field of Classification Search
CPC ..... H01F 6/00; H01F 6/02; H01F 6/04; H01F 6/06; H01F 6/008; H01F 5/08; H01F 7/22;
(Continued)

(56) References Cited

U.S. PATENT DOCUMENTS 4,807,084 A * 2/1989 Takechi ..... H01F 6/006 335/216
5,625,332 A * 4/1997 Kamo ..... H01L 39/143 174/125.1
(Continued)

FOREIGN PATENT DOCUMENTS

JP 64-049286 A 2/1989
JP 03-093206 A 4/1991
(Continued)

OTHER PUBLICATIONS

International Search Report of PCT/JP2013/080847 dated Feb. 10, 2014.

*Primary Examiner* — Shawki S Ismail
*Assistant Examiner* — Lisa Homza
(74) *Attorney, Agent, or Firm* — Mattingly & Malur, PC

(57) ABSTRACT

This superconducting magnet includes: a superconducting coil that is formed by winding a first superconducting wire rod; a second superconducting wire rod, which is disposed by being thermally in contact with and electrically insulated from the superconducting coil, and which has a superconducting transition temperature that is lower than that of the first superconducting wire rod; voltage terminals that are disposed at a plurality of areas of the second superconducting wire rod; a voltmeter connected to the voltage terminals; and a switch circuit connected to the voltmeter. The switch circuit interrupts a current when receiving an output from the voltmeter, the current being one that is to be supplied to the superconducting coil.

8 Claims, 3 Drawing Sheets

(58) Field of Classification Search
CPC . H01F 27/28; H02H 7/00; H02H 9/00; H02H 9/02
USPC ..... 335/216
See application file for complete search history.

(56) References Cited

U.S. PATENT DOCUMENTS 6,646,836 B2 * 11/2003 Yoshikawa ..... G01R 33/3815 361/141
7,224,250 B2 * 5/2007 Nemoto ..... H01F 6/04 335/216
2004/0027737 A1 * 2/2004 Xu ..... H02H 7/001 361/19
2006/0158795 A1 * 7/2006 Tsuchiya ..... H02H 7/001 361/19
2009/0040664 A1 * 2/2009 Higuchi ..... G01R 33/3806 361/19
2009/0103217 A1 * 4/2009 Langtry ..... G01R 33/288 361/19
2010/0295641 A1 * 11/2010 Schild ..... H01F 6/008 335/216
2011/0069418 A1 * 3/2011 Huang ..... G01R 33/288 361/19
2012/0071326 A1 * 3/2012 Wu ..... H01F 6/02 505/163
2012/0182012 A1 * 7/2012 Lvovsky ..... G01R 33/3815 324/318
2013/0027816 A1 * 1/2013 Badel ..... H02H 7/001 361/19
2014/0329688 A1 * 11/2014 Aoki ..... G01R 33/3815 505/162
2014/0357491 A1 * 12/2014 Nakagawa ..... H01F 6/06 505/163
2015/0111753 A1 * 4/2015 Nakagawa ..... H01F 6/02 505/163
2016/0343491 A1 * 11/2016 Miyazoe ..... G01R 33/3815

FOREIGN PATENT DOCUMENTS

JP 08-304271 A 11/1996
JP 2000-277322 A 10/2000
JP 2008-016554 A 1/2008
JP 2012-238628 A 12/2012

* cited by examiner

SUPERCONDUCTING MAGNET

TECHNICAL FIELD

The present invention relates to a superconducting magnet.

BACKGROUND ART

Background art of the technical field can be found in Japanese Unexamined Patent Application Publication No. 2012-238628 (Patent Literature 1). This literature describes that "it is an object of the invention to provide a high-temperature superconducting magnet capable of detecting with a high accuracy a voltage at which a quench occurs which corresponds to a normal conduction transition phenomenon of a superconducting coil and thereby quickly detecting an occurrence of the quench and performing a protective operation, in which the occurrence of the quench is detected by winding the superconducting magnet with a parallel conductor constituted by electrically connecting constituent conductors each other by at least two points, arranging voltage terminals at a superconducting wire rod in each section of the electrically connected parallel conductor, and observing the potential difference."

Moreover, there is also Japanese Unexamined Patent Application Publication No. Hei 8(1996)-304271 (Patent Literature 2). This literature describes that "aiming at providing an apparatus and a method for detecting a quench occurrence capable of sensing a minute change thereof and observing the change of a whole system at an initial stage of the quench occurrence, the apparatus for detecting the quench of a superconducting wire rod detects by using an optical fiber wound around the superconducting wire rod, a light source emitting a deflected beam into the optical fiber, and a device that detects a polarization from the optical fiber."

CITATION LIST

Patent Literature 1: Japanese Unexamined Patent Application Publication No. 2012-238628
Patent Literature 2: Japanese Unexamined Patent Application Publication No. Hei 8(1996)-304271

SUMMARY OF INVENTION

Technical Problem

However, connection of the voltage terminal in each section by soldering, for example, would make the configuration of the superconducting coil complicated. Moreover, to detect a quench using the deflected beam, it would require a plurality of polarizing plates and mirrors to form the deflected beam, which makes the measurement system more complicated.

Thus, an object of the present invention is to provide a superconducting magnet that makes it possible to detect a temperature increase due to normal conduction transition of a superconducting coil with a simple configuration.

Solution to Problem

To solve the aforementioned problems, for example, a configuration described in one of the appended claims is employed.

This application includes a plurality of means for solving the aforementioned problem, one example of which is characterized in that "it includes: a superconducting coil that is formed by winding a first superconducting wire rod; a second superconducting wire rod, which is assembled by being thermally in contact with and electrically insulated from the superconducting coil, and which has a superconducting transition temperature lower than that of the first superconducting wire rod; voltage terminals connected at a plurality of locations on the second superconducting wire rod; a voltmeter connected to the voltage terminals; and a switch circuit connected to the voltmeter, and that the switch circuit interrupts a current to be supplied to the superconducting coil upon receiving an output from the voltmeter."

Advantageous Effects of Invention

The present invention can provide a superconducting magnet making it possible to detect a temperature increase due to normal conduction transition of a superconducting coil with a simple configuration.

DESCRIPTION OF EMBODIMENTS

Hereinbelow, embodiments of the present invention will be described with reference to drawings.

First Embodiment

A superconducting magnet 1 of this embodiment will be described with reference to FIGS. 1 and 6.

Figure 6:
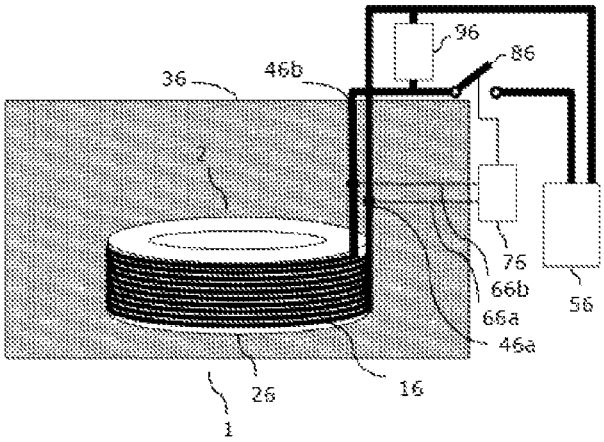
FIG. 6 A basic configuration diagram of the superconducting magnet.

FIG. 6 shows a basic configuration of the superconducting magnet 1. As shown in FIG. 6, the basic configuration of the superconducting magnet 1 includes a superconducting coil 2 and a cryostat 36.

The superconducting coil 2 is formed by winding a superconducting wire rod 16 around a winding frame 26. The superconducting wire rod 16 is connected at its end to an external power source 56 by the current leads 46*a*, 46*b*, and the superconducting coil 2 can generate a magnetic field upon receiving a current supplied from the external power source 56.

Moreover, the superconducting magnet 1 needs to cool the superconducting coil 2 to a certain temperature or lower to retain a superconducting state. In this embodiment, the superconducting coil 2 is retained under a low temperature by immersing it in a cooling medium, e.g. liquid helium, in the cryostat 36.

It should be noted that any cooling method can be used such as a method of immersing it in a liquid cooling medium or a conduction cooling method using a metal having a high thermal conductivity such as pure copper. A refrigerator (not shown) may be used for cooling the cooling medium or for conduction cooling, and a thermal shield (not shown) may be provided so as to cover the superconducting coil 2 in order to block heat penetration from the outside.

The superconducting coil 2 is connected to the external power source 56 via the current leads 46*a*, 46*b*, as described above. When operating the superconducting magnet 1, the external power source 56 should energize the superconducting coil 2, and the current must be interrupted if any failure occurs to the superconducting coil 2 or the circuit that includes the superconducting coil 2 at this time.

Especially, if there is a phenomenon (quench phenomenon) in which the temperature increases in a part of the superconducting coil 2 for some reason and an electrical resistance arises from normal conduction transition in this part, which results in a chain reaction of the normal conduction transition all over the superconducting coil 2, it is desirable to immediately stop the energization to the superconducting coil 2 and consume accumulated magnetic energy so that the superconducting coil 2 will not be broken. Causes of unexpected normal conduction transition of the superconducting coil may include deterioration and a manufacturing error of the superconducting coil 2, a failure of the refrigerator, a breakage of the thermal shield, and the like.

In order to stop the energization to the superconducting coil 2 and consume the accumulated magnetic energy when the failure of the superconducting magnet 1 occurs, the following methods can be contemplated.

For example, the electrical resistance caused by the normal conduction transition in apart of the superconducting coil 2 is detected by measuring a voltage related to the resistance using the voltage terminals 66*a*, 66*b*. The measurement of the voltage can be implemented by providing the voltage terminals 66*a*, 66*b* at unwinding portions of the superconducting wire rod 16 forming the superconducting coil 2, respectively.

The measurement result of the voltage is transmitted to a switch drive circuit 76, and the switch drive circuit 76 that received the result opens a switch 86, whereby connection between the superconducting coil 2 and the external power source 56 is interrupted to stop the energization to the superconducting coil 2. Furthermore, by opening the switch 86, a closed circuit is formed with the superconducting coil 2 and a protection circuit 96. In this closed circuit, the energy accumulated in the superconducting coil 2 is consumed as heat generated in a protection resistor included in the protection circuit 96, thereby suppressing energy release caused by the superconducting coil 2 generating the heat itself.

Figure 1:
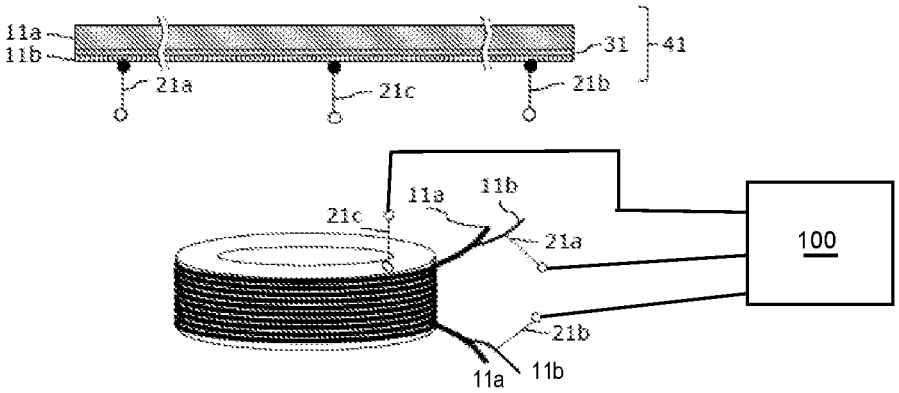
FIG. 1 A configuration diagram of a superconducting coil that senses a temperature increase according to a first embodiment of the present invention.

FIG. 1 shows a detailed configuration of the superconducting coil 2 in this embodiment.

In this embodiment, the superconducting wire rod 16 includes a wire rod 11*a* that is a first superconducting wire rod and a wire rod 11*b* that is a second superconducting wire rod, and the wire rod 11*a* and the wire rod 11*b* are constituted by wire rods having different conducting transition temperatures. Moreover, this embodiment employs the wire rod 11*a* having a conducting transition temperature higher than that of the wire rod 11*b*.

These wire rods 11*a*, 11*b* are coated with an electrical insulating material 31 like a resin, for example, to be electrically insulated from one another while being thermally in contact with one another. The superconducting coil 2 is formed by winding a conductor 41 including the wire rod 11*a*, the wire rod 11*b*, and the electrical insulating material 31.

In the superconducting coil 2 according to this embodiment, a coil made of the wire rod 11*a* having a higher conducting transition temperature among the two different wire rods 11*a*, 11*b* acts as a main superconducting coil mainly intended to generate the magnetic field. On the other hand, a coil formed of the wire rod 11*b* having a lower conducting transition temperature acts as a sub superconducting coil mainly intended to detect the temperature increase. The external power source 56 may be connected to the main superconducting coil and the sub superconducting coil may be configured to be connected to another current source prepared separately.

Attached to both ends of the wire rod 11*b* are voltage terminals 21*a*, 21*b*, and a single voltage terminal 21*c* is attached within the winding, that is, to the intermediate portion of the wire rod. Thus, in the wire rod 11*b*, when the normal conduction transition occurs between the voltage terminal 21*a* and the voltage terminal 21*c*, the voltage is measured between these terminals, and if the normal conduction transition occurs between the voltage terminal 21*b* and the voltage terminal 21*c*, the voltage is measured between these terminals. A voltmeter 100 is connected to the voltage terminals 21*a*, 21*b*, and 21*c*.

Hereinbelow, a function of detecting the temperature increase in the main superconducting coil using the sub superconducting coil formed of the wire rod 11*b* will be explained.

Figure 2:
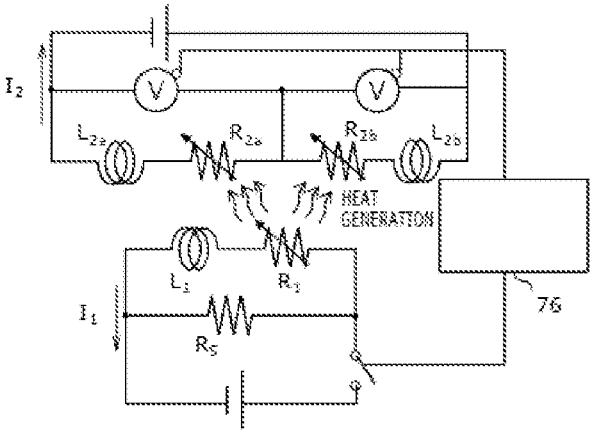
FIG. 2 An exemplary circuit diagram of the superconducting magnet that senses the temperature increase according to the first embodiment of the present invention.

FIG. 2 is an exemplary circuit diagram for detecting the temperature increase in the superconducting magnet.

While operating the superconducting magnet 1, the current is applied from the external power source 56 to the superconducting coil 2. If there occurs transition from the superconducting state to the normal conducting state in the wire rod 11*a* constituting the main superconducting coil for some reason, a resistance value of the main superconducting coil changes from $R_1>=0$ to $R_1>0$.

Assuming the applied current as $I_1$, a heat amount of $R_1I_1^2$ is generated in the portion of the main superconducting coil where the normal conduction transition occurred. Because the heat is also transferred to other portions than where the normal conduction transition occurred first, a region of which the temperature exceeds the superconducting transition temperature, namely the normal conduction transition region, expands in the wire rod 11*a*, and consequently the $R_1$ of the main superconducting coil increases according to the elapsed time.

On the other hand, the heat generated in the wire rod 11*a* also propagates to the wire rod 11*b* thermally in contact with the wire rod 11*a*. This causes the normal conduction transition in the wire rod 11*b* and therefore a resistance $R_{2a}$ or $R_{2b}$ is also generated in the sub superconducting coil formed of the wire rod 11*b*. Assuming the current flowing through the sub superconducting coil as $I_2$, the heat amount generated in the wire rod 11*b* is $R_{2a}I_2^2$ or $R_{2b}I_2^2$, for this heat generation the normal conduction transition region also expands in the sub superconducting coil, and consequently the resistance value ($R_{2a}$, $R_{2b}$) of the sub superconducting coil formed of the wire rod 11*b* also increases according to the elapsed time.

In this manner, when the normal conduction transition occurs in the superconducting coil 2, the normal conduction transition region expands in both of the main superconducting coil and the sub superconducting coil. However, compared to the wire rod 11*a*, the wire rod 11*b* has a smaller heat capacity before the normal conduction transition because it has a lower conducting transition temperature. Therefore, the propagation speed of the normal conduction transition region is higher in the wire rod 11*b* than in the wire rod 11*a*.

For example, when using a niobium titanium wire rod as the wire rod 11*b* and a bismuth-based copper oxide superconducting wire rod as the wire rod 11*a*, the propagation speed of the normal conduction transition region in the wire rod 11*b* can be 1000 times or more of the propagation speed in the wire rod 11*a* that is several mm/s.

The strength of the voltage generated in the superconducting coil increases along with the propagation of the normal conduction transition region because it depends on the size of the normal conduction transition region. Thus, the voltage generated in the sub superconducting coil formed of the wire rod 11*b* has a higher increase rate than the voltage generated in the main superconducting coil formed of wire rod 11*a* having a larger heat capacity before the normal conduction transition than that of the wire rod 11*b*.

Now, the superconducting magnet 1 according to this embodiment measures the voltage generated in the sub superconducting coil formed of the wire rod 11*b*, opens the switch 86 through the switch drive circuit 76 according to the voltage value, and interrupts the connection between the external power source 56 and the superconducting coil 2. The mechanism of interrupting sharing of the current to the superconducting coil 2 or the main superconducting coil by interrupting the connection between the external power source 56 and the superconducting coil 2 may employ a breaker instead of the switch 86. For the reasons above, the superconducting magnet 1 according to the first embodiment does not necessarily require electrical connection to detect the voltage of the main superconducting coil.

After shutting down the external power source 56, the magnetic energy 0.5 $L_1I_1^2$ accumulated in the main superconducting coil formed of the wire rod 11*a* is released by a protection resistor $R_s$ for relaxation time of $L_1/R_s$.

When there is a certain degree of difference between the superconducting transition temperatures of the wire rod 11*a* and the wire rod 11*b*, even in a state where the temperature increase is observed in the main superconducting coil but the normal conduction transition has not occurred yet, the normal conduction transition in the sub superconducting coil deriving from the heat propagated from the main superconducting coil can be detected, and therefore it is possible to stop the superconducting magnet 1 at a stage where the load applied to the main superconducting coil is still small.

Furthermore, an attachment position of the voltage terminal 21*c* may be the position where $L_{2a}=L_{2b}$ is achieved as shown in FIG. 2 to cancel an inductance $L_2$ ($=L_{2a}+L_{2b}$) due to the winding. Specifically, because the voltage terminals 21*a*, 21*b* are provided on both ends of the wire rod 11*b*, for example, in the proximity of the unwinding portions, the voltage terminal 21*c* may be provided at a position corresponding to the midpoint between the voltage terminals 21*a*, 21*b*.

Thus, by arranging the voltage terminals 21*a*, 21*b*, 21*c* as described above, it is possible to measure the difference between voltages generated at $L_{2a}$ and $L_{2b}$, and to highly accurately detect an abnormality in the wire rod 11*a* assuming that there is no resistance caused by a temperature increase if the difference is zero and that there is the resistance cause by the temperature increase if any difference is detected.

Additionally, the voltage between the voltage terminal 21*a* and the voltage terminal 21*b* may be measured while the superconducting magnet 1 is properly operating, and the temperature increase in the wire rod 11*a* may be detected based on the difference between the measured reference voltage and a voltage measured in real time. In this case, because there is no need of arranging the voltage terminal 21*c*, the mechanism of detecting the temperature increase in the main superconducting coil can be simplified.

As described above, the superconducting magnet 1 according to this embodiment does not need to connect the wound superconducting wire rods in parallel with each other or to provide voltage terminal pairs by separating the superconducting wire rod into small sections in order to detect the generated voltage in the main superconducting coil, and it makes it possible to detect the generated voltage with a simple structure.

Furthermore, provided that the wire rod 11*a* and the wire rod 11*b* are thermally in contact with each other, there is no need of attaching a voltage terminal pair to the main superconducting coil formed of the wire rod 11*a*. That is, because no heat is applied to the wire rod 11*a* due to soldering, it is possible to prevent degradation of superconducting properties of the wire rod 11*a*.

For example, when using so-called high-temperature superconducting wire rod such as a bismuth-based copper oxide wire rod or an yttrium-based copper oxide wire rod as the wire rod 11*a* and 200° C. or higher heat is applied thereto by a soldering iron, its superconducting properties may be degraded. However, this embodiment can reduce the connection with soldering, which is especially effective in reducing degradation factors of the superconducting properties when fabricating the superconducting coils using the high-temperature superconducting wire rod as the main wire rod.

Second Embodiment

In this embodiment, in addition to the superconducting coil having the voltage terminal within the winding, an example of a superconducting coil capable of detecting the temperature increase using only the voltage terminal pair on both ends is described.

Figure 3:
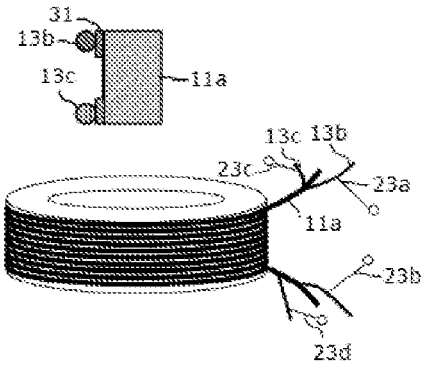
FIG. 3 An exemplary configuration diagram of a superconducting coil that requires no voltage terminal within a winding according to a second embodiment of the present invention.

FIG. 3 is an exemplary configuration diagram showing a superconducting coil according to the second embodiment.

In the superconducting coil 2 shown in FIG. 1, the components having the same function as the configurations denoted by the same reference numerals as those already described with reference to FIG. 1 will not be described any further.

In the second embodiment, two second superconducting wire rods 13*b*, 13*c* thermally in contact with the wire rod 11*a* are wound. The wire rods 13*b*, 13*c* form two sub superconducting coils having the same inductance $L_2'$. Voltage terminals 23*a*, 23*b*, 23*c*, 23*d* are provided at both ends of the sub superconducting coils to measure voltages.

Figure 4:
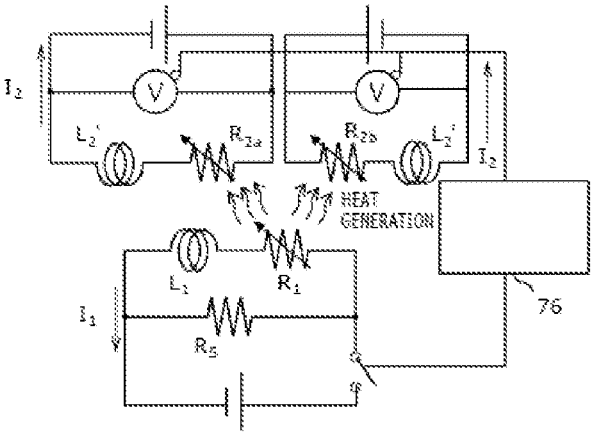
FIG. 4 An exemplary circuit diagram of the superconducting magnet that requires no voltage terminal within the winding and that senses a temperature increase according to the second embodiment of the present invention.

FIG. 4 shows an exemplary circuit diagram of the second embodiment.

As shown in FIG. 4, currents are applied to the sub superconducting coils formed of the wire rods 13*b*, 13*c* in opposite directions. The inductance $L_2'$ can be canceled by applying the currents in this manner, thereby eliminating a need of the voltage terminal within the winding. It is now possible to interrupt the current in the main superconducting coil formed of the wire rod 11*a* via the switch drive circuit 76, as in the first embodiment, according to the voltage values measured by the voltage terminal pair 23*a*, 23*b* and the voltage terminal pair 23*c*, 23*d*.

Although the first embodiment requires an operation of identifying the position in which the inductance $L_{2a}=L_{2b}$ is achieved when disposing the voltage terminal within the winding, the identifying operation can be omitted in the second embodiment, thereby reducing the load of fabricating the superconducting coil 2.

It should be noted that there may be prepared a plurality of wire rods 13*b* and wire rods 13*c* and the same number of them may be wound around the main superconducting coil. In doing so, the number of the wire rods to which the current is applied in one direction should be same as the number of the wire rods to which the current is applied in an opposite direction.

Third Embodiment

In this embodiment, in addition to the superconducting magnet formed by twisting the first superconducting wire rod and the second superconducting wire rod together, an example of a superconducting magnet capable of detecting the temperature increase by partially bringing the second superconducting wire rod into thermal contact will be described.

Figure 5:
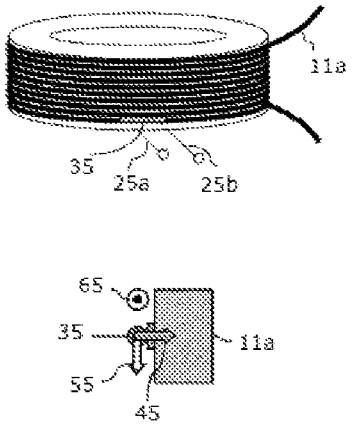
FIG. 5 An exemplary configuration diagram of a superconducting coil that senses a temperature increase in a selected area according to a third embodiment of the present invention.

FIG. 5 is an exemplary configuration diagram showing a superconducting coil according to the third embodiment.

In the superconducting coil shown in FIG. 1, the components having the same function as the configurations denoted by the same reference numerals as those already described with reference to FIG. 1 will not be described any further.

In the third embodiment, a second superconducting wire rod 35 is brought into contact from a surface of the superconducting coil with an outer peripheral surface of the superconducting coil formed of the wound first superconducting wire rod 11*a*, namely the outer peripheral surface of the superconducting coil formed into a cylindrical shape. Voltage terminals 25*a*, 25*b* are provided at both ends of the wire rod 35 to measure the voltage, and the current in the superconducting coil formed of the first wire rod 11*a* is interrupted according to the measure voltage, as in the first or second embodiment. Because the wire rod 35 is made shorter, unlike the first or second embodiment, the inductance due to the second wire rod is low and there is no need of forming a circuit to cancel the inductance.

Moreover, the wire rod 35 may be disposed with respect to the coil formed of the wire rod 11*a* as described below. First, the wire rod 35 is disposed to be parallel with the wire rod 11*a* as much as possible. The direction of the current applied to the wire rod 35 should be the same direction as the current applied to the wire rod 11*a*. By disposing the wire rod 35 and controlling the direction of the current as described above, an electromagnetic force is applied to the wire rod 35 in the direction 45 due to the direction 55 of the magnetic field generated by the superconducting coil formed of the wire rod 11*a*. As a result, the wire rod 35 receives a force to be pressed against the wire rod 11*a*, thereby reducing the contact thermal resistance between the first and second superconducting wire rods 11*a*, 35 and improving an accuracy of detecting the temperature increase.

It should be noted that the structures of detecting the generated voltage including the wire rod 35 and the voltage terminals 25*a*, 25*b* connected to the both ends of the wire rod 35 may be provided at a plurality of locations on the superconducting coil formed of the wire rod 11*a*. By disposing the structures at the plurality of locations, it is made possible to detect the temperature increase in the superconducting coil formed of the wire rod 11*a* with a higher accuracy.

LIST OF REFERENCE SIGNS

1 Superconducting magnet
2 Superconducting coil
11*a*, 16 First superconducting wire rod
11*b*, 13*b*, 13*c*, 35 Second superconducting wire rod
21*a*, 21*b*, 21*c*, 23*a*, 23*b*, 23*c*, 23*d*, 25*a*, 25*b*, 66*a*, 66*b* Voltage terminal
31 Electrical insulating material
41 Parallel conductor
45 Direction of electromagnetic force
55 Direction of magnetic field generated by main superconducting coil formed of first superconducting wire rod
65 Direction of current in second superconducting wire rod
26 Winding frame
36 Cryostat
46*a*, 46*b* Current lead
56 External power source
76 Switch drive circuit
86 Switch
96 Protection circuit

The invention claimed is:

1. A superconducting magnet, comprising:

a superconducting coil that is formed by winding a first superconducting wire rod;

a second superconducting wire rod, which is disposed by being thermally in contact with and electrically insulated from the superconducting coil, and which has a superconducting transition temperature lower than that of the first superconducting wire rod;

voltage terminals disposed at a plurality of locations on the second superconducting wire rod;

a voltmeter connected to the voltage terminals; and a switch circuit connected to the voltmeter, wherein the switch circuit interrupts a current to be supplied to the superconducting coil upon receiving an output from the voltmeter.

2. The superconducting magnet according to claim 1, wherein the second superconducting wire rod is wound around together with the first superconducting wire rod, and the voltage terminals are disposed at both ends of the second superconducting wire rod.

3. The superconducting magnet according to claim 2, wherein a voltage terminal is further disposed at an intermediate point of the second superconducting wire rod with respect to the both ends thereof, and wherein the voltmeter is connected to each of the voltage terminals disposed at both ends of the second superconducting wire rod and the voltage terminal disposed at the intermediate point of the second superconducting wire rod.

4. The superconducting magnet according to claim 1, wherein a same number of second superconducting wire rods are wound around together with the first superconducting wire rods, and a number of the second superconducting wire rods in which a current is applied in one direction is the same as the number of the second superconducting wire rods in which a current is applied in another direction different from the one direction.

5. The superconducting magnet according to claim 1, wherein the second superconducting wire rod is a member having a length shorter than a perimeter of an outer peripheral surface of the superconducting coil and disposed on the outer peripheral surface of the superconducting coil, and the voltage terminals are connected to both ends of the second superconducting wire rod.

6. The superconducting magnet according to claim 5, wherein in the second superconducting wire rod, a current is applied in a direction in which a force attracted toward the superconducting coil is acted by an electromagnetic force generated by the superconducting coil.

7. The superconducting magnet according to claim 1, wherein the first superconducting wire rod and the second superconducting wire rod are connected to separate current sources, respectively.

8. The superconducting magnet according to claim 1, wherein the superconducting magnet energizes the second wire rod and detects heat generated in the superconducting magnet based on normal conduction transition in the second wire rod.

* * * * *